US011033947B2

(12) United States Patent
Leacock

(10) Patent No.: US 11,033,947 B2
(45) Date of Patent: Jun. 15, 2021

(54) METHOD AND APPARATUS FOR FORMING DOUBLE CURVATURE CORRUGATED AND SURFACE TEXTURED PANELS

(71) Applicant: University of Ulster, Coleraine (GB)

(72) Inventor: Alan Leacock, Carrickfergus (GB)

(73) Assignee: Tirnaform Limited, Carrickfergus (IE)

( * ) Notice: Subject to any disclaimer, the term of this patent is extended or adjusted under 35 U.S.C. 154(b) by 280 days.

(21) Appl. No.: 15/767,563

(22) PCT Filed: Oct. 7, 2016

(86) PCT No.: PCT/EP2016/074071
§ 371 (c)(1),
(2) Date: Apr. 11, 2018

(87) PCT Pub. No.: WO2017/063955
PCT Pub. Date: Apr. 20, 2017

(65) Prior Publication Data

US 2018/0311718 A1 Nov. 1, 2018

(30) Foreign Application Priority Data

Oct. 12, 2015 (GB) ..... 1518038

(51) Int. Cl.
*B21D 11/02* (2006.01)
*B21D 25/02* (2006.01)
*B21D 37/02* (2006.01)

(52) U.S. Cl.
CPC ..... *B21D 25/02* (2013.01); *B21D 11/02* (2013.01); *B21D 37/02* (2013.01)

(58) Field of Classification Search
CPC ..... B21D 11/02; B21D 11/206; B21D 11/20; B21D 25/02; B21D 13/10; B21D 37/02
See application file for complete search history.

(56) References Cited

U.S. PATENT DOCUMENTS 5,860,314 A * 1/1999 Powers, III ..... B21D 11/02 72/297
6,053,026 A 4/2000 Nardiello et al.
(Continued)

FOREIGN PATENT DOCUMENTS

CN 102205366 10/2011
DE 607377 12/1934
(Continued)

OTHER PUBLICATIONS

International Search Report of corresponding PCT Application No. PCT/EP2016/074071, dated Jul. 2, 2017.
(Continued)

*Primary Examiner* — Debra M Sullivan
(74) *Attorney, Agent, or Firm* — Gardner Linn

(57) ABSTRACT

A method of stretch forming a double curvature panel having corrugations or other surface features formed therein includes providing a reconfigurable forming surface defined by a flexible interpolator sheet mounted on an array of height adjustable pins, the interpolator sheet having a profiled upper surface adapted to form corrugations or other surface features in a workpiece as it is stretched over the forming surface, adjusting the height of each pin to suit the shape of the panel to be produced, placing a workpiece onto the forming surface, and stretching the workpiece over the forming surface such that the profiled upper surface of the interpolator sheet forms the desired corrugations or other surface features in the workpiece.

20 Claims, 5 Drawing Sheets

(56) References Cited

U.S. PATENT DOCUMENTS

| | | | |
|---|---|---|---|
| 2012/0291512 | A1 | 11/2012 | Kang et al. |
| 2016/0354829 | A1 | 12/2016 | Leacock |

FOREIGN PATENT DOCUMENTS

| | | | | |
|---|---|---|---|---|
| DE | 4213490 | C1 * | 9/1993 | ..... B21D 37/02 |
| WO | WO2007085041 | | 8/2007 | |
| WO | WO2009145538 | | 12/2009 | |
| WO | WO2015113954 | | 8/2015 | |

OTHER PUBLICATIONS

UK Search Report of corresponding UK Application No. GB1518038.3, dated Mar. 22, 2016.

* cited by examiner

METHOD AND APPARATUS FOR FORMING DOUBLE CURVATURE CORRUGATED AND SURFACE TEXTURED PANELS

CROSS REFERENCE TO RELATED APPLICATIONS

The present application is a § 371 national stage of International Application PCT/EP2016/074071, filed Oct. 7, 2016, which claims priority benefit of U.K. Pat. Application Ser. No. 1518038.3, filed Oct. 12, 2015, all of which are hereby incorporated herein by reference in their entireties.

FIELD OF THE INVENTION

This invention relates to a method and apparatus for forming double curvature corrugated and surface textured panels and in particular a method and apparatus for stretch forming double curvature corrugated and surface textured panels using a reconfigurable metal forming apparatus.

BACKGROUND OF THE INVENTION

The production of low volume sheet metal components is a difficult balancing act of non-recurrent equipment cost and final component sale value. Industry sectors in which low volume components are commonplace include aerospace, marine and architecture. Each of these industry sectors presents unique challenges that are a combination of the component material, tolerances required and number of repeat components. While Aerospace utilises high strength metals that must meet stringent dimensional tolerances manufactured in reasonable batch numbers, architecture typically employs comparatively lower strength metals with wider dimensional tolerances and often single component manufacture.

Traditional manufacturing methods employed in the production of components for these industry sectors often utilise fixed tools and large complex machines that require substantial foundations. Tooling costs can be reduced through the use of processes such as stretch forming where, depending upon the component shape, only a single male tool is required. Costs can be further reduced through the reuse of tooling by machining the tool multiple times. Nevertheless, such innovations are limited in the achievable cost savings.

Where it is desired to produce corrugated and surface textured panels having compound or double curvature it has been necessary to utilise expensive fixed tooling and/or to form separate reinforcing ribs that must be attached to a formed metal sheet by riveting or welding using special jigs to correctly locate the ribs upon the sheet. Roll forming techniques can be used to create straight and single curvature corrugated panels. However, such technique cannot produce compound or double curvature corrugated or surface textured panels.

SUMMARY OF THE INVENTION

The present invention provides a relatively low cost and highly adaptable reconfigurable metal forming method and apparatus. According to a first aspect of the present invention there is provided a method of stretch forming a double curvature panel having corrugations or other surface features formed therein comprising providing a reconfigurable forming surface defined by a flexible interpolator sheet mounted on an array of height adjustable pins, the interpolator sheet having a profiled upper surface adapted to form corrugations or other surface features in a workpiece as it is stretched over the forming surface, adjusting the height of each pin to suit the shape of the panel to be produced, placing a workpiece onto the forming surface and stretching the workpiece over the forming surface such that the profiled upper surface of the interpolator sheet forms the desired corrugations or other surface features in the workpiece.

The method may comprise the steps of gripping the workpiece in workpiece gripping devices provided on opposite sides of the array of pins, and displacing the gripping devices in opposing directions and/or raising the pins to stretch the workpiece over the forming surface.

Optionally, the interpolator sheet is mounted on the array of pins such that a major profile of the surface features defining the profiled upper surface of the interpolator sheet are substantially aligned with the direction in which the workpiece is stretched over the forming surface The array of pins may be displaced upwardly as the gripping devices are displaced in opposite directions.

The method may comprise the further step of removing the workpiece from the forming surface and trimming the workpiece to remove at least the portions held in the gripping devices.

The method may further comprise the further steps of replacing the profiled interpolator with a second interpolator sheet having a substantially smooth outer surface, maintaining the height of each pin, placing a second workpiece onto the forming surface defined by the second interpolator sheet and gripping the second workpiece in the workpiece gripping devices, and displacing the gripping devices in opposing directions to stretch the second workpiece over the forming surface and removing the second workpiece from the forming surface, placing the second workpiece in registration with the workpiece having corrugations or other surface features formed therein and joining the workpieces to form an integrally stiffened panel. The workpieces may be joined by one or more of an adhesive applied to abutting surfaces of the workpieces, mechanical fasteners, such as rivets, or a welding process, such as spot welding.

According to a further aspect of the present invention there is provided a reconfigurable stretch forming apparatus comprising an array of pins adapted to be individually adjustable in height, wherein a flexible interpolator sheet is mounted on top of the array of pins to define a reconfigurable forming surface, a pair of workpiece gripping devices being provided on opposite sides of the array of pins, each gripping device having a support surface for supporting a workpiece and a clamping member for clamping a work piece against the support surface, a drive device being provided for displacing the gripping devices in opposing directions and/or raising the array of pins to stretch the work piece over the forming surface, the interpolator sheet having a profiled upper surface adapted to form corrugations or other surface features in a workpiece as it is stretched over the forming surface defined by the interpolator sheet.

Optionally, the interpolator sheet may incorporate varying thickness regions to define the profiled upper surface thereof.

Optionally, a major profile of the surface features defining the profiled upper surface of the interpolator sheet are substantially aligned with the direction in which the work piece is stretched over the forming surface.

In one embodiment the profiled upper surface of the interpolator sheet may define a plurality of substantially parallel ribs adapted to form corresponding corrugations in the workpiece. The ribs may be aligned to extend between the gripping devices over the forming surface.

A second interpolator sheet may be provided having a substantially smooth outer surface which can be exchanged for the profiled interpolator sheet to produce a panel having a substantially smooth surface.

The profiled interpolator sheet and the second interpolator sheet may be adapted to be used subsequently to one another to produce separate formed sheets upon the same configuration of pins to produce a smooth panel and a corrugated panel which can be subsequently joined to produce an integrally reinforced multi-layer panel.

In one embodiment each of the gripping devices may comprise a roller, an outer surface of the roller defining the arcuate support surface of the respective gripping device. The clamp member of each gripping device may comprise an eccentrically mounted cam or roller mounted adjacent the arcuate support surface of the respective gripping device, an outer surface of the clamp member defining a clamping surface acting against the arcuate support surface to clamp a workpiece thereagainst, wherein the clamp member is rotatable between a first position, wherein the clamping surface of the clamp member is spaced from the arcuate support surface, and a second position, wherein the clamping surface of the clamp member engages the arcuate support surface. The clamp member of each gripping device may be eccentrically rotatable about an axis extending parallel to a rotation axis of the respective gripping device. The direction of rotation of the clamp member of each gripping device between its first and second positions may be arranged such that the respective clamp member is biased towards its second position under the action of the workpiece during a stretch forming operation.

Optionally, the array of pins and the flexible interpolator sheet supported thereon define an arcuate forming surface extending between the gripping devices.

An end cap may be mounted on an upper end of each pin, wherein each end cap is articulated with respect to the pin upon which the end cap is mounted to permit tilting of the end cap with respect to the pin.

The gripping devices may be linked via one or more gears and/or linkages to ensure that they are displaced by equal amounts when the drive device is operated to ensure even stretching of the blank over the forming surface.

These and other objects, advantages and features of the invention will become apparent upon review of the following specification in conjunction with the drawings.

BRIEF DESCRIPTION OF THE DRAWINGS

A reconfigurable metal forming apparatus in accordance with an embodiment of the present invention will now be described, by way of example only, with reference to the accompanying drawings, in which:—

DESCRIPTION OF THE PREFERRED EMBODIMENTS

Figure 1:
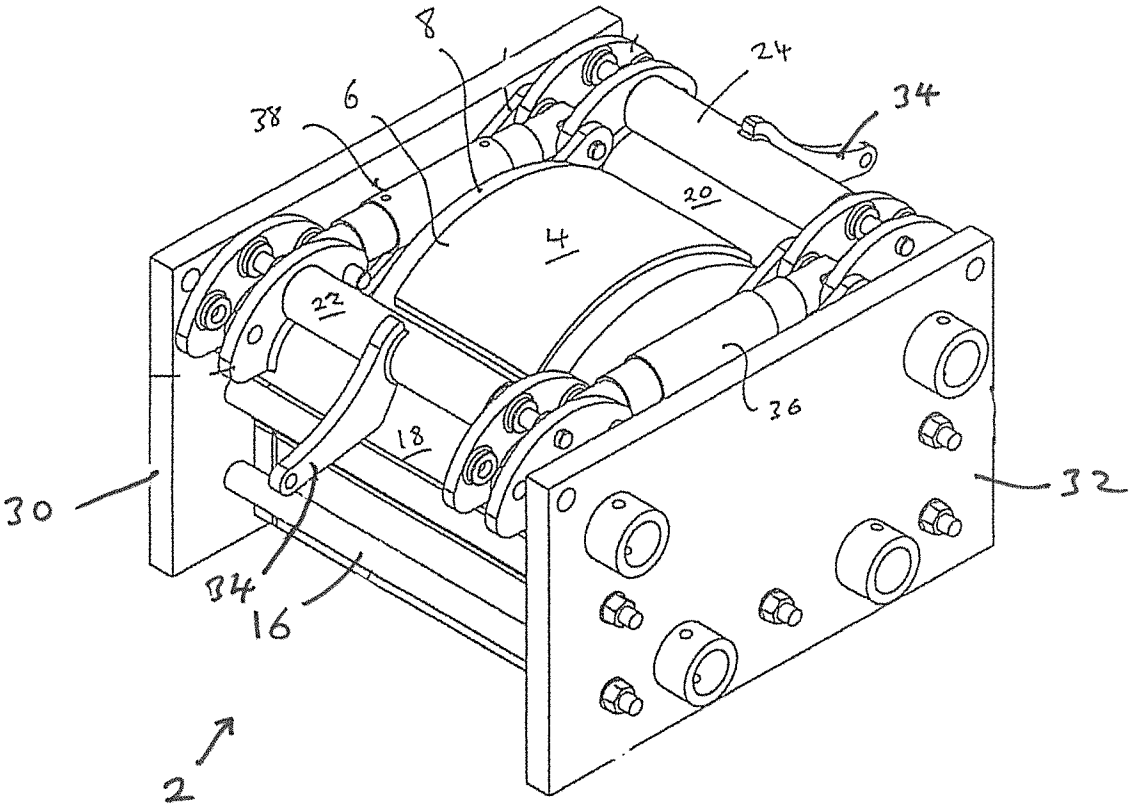
FIG. 1 is a perspective view of a metal forming apparatus in accordance with an embodiment of the present invention.

As illustrated in FIG. 1, a reconfigurable stretch forming apparatus 2 in accordance with an embodiment of the present invention comprises an arcuate reconfigurable forming surface 4 defined by a flexible interpolator (flexible covering sheet) 6 located on top of a pin array 8, each pin 10 of the array 8 being individually adjustable in height to alter the shape of the forming surface 4.

Figure 2:
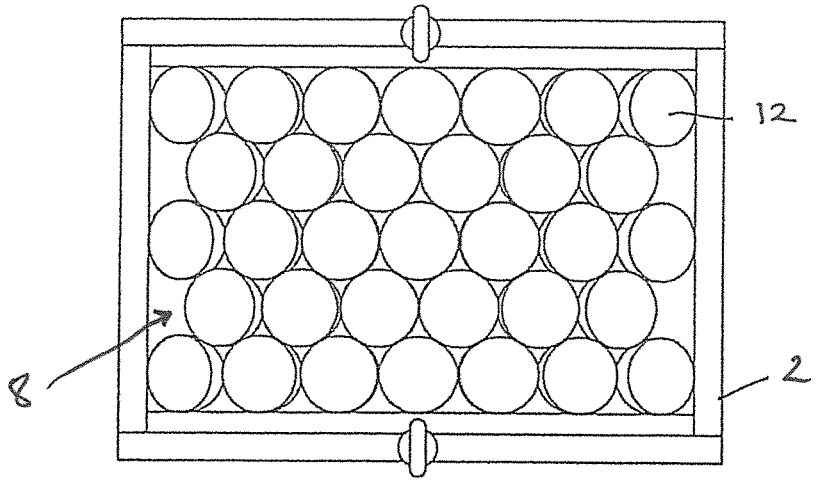
FIG. 2 is a plan view of a pin array of the apparatus of FIG. 1.
Figure 3:
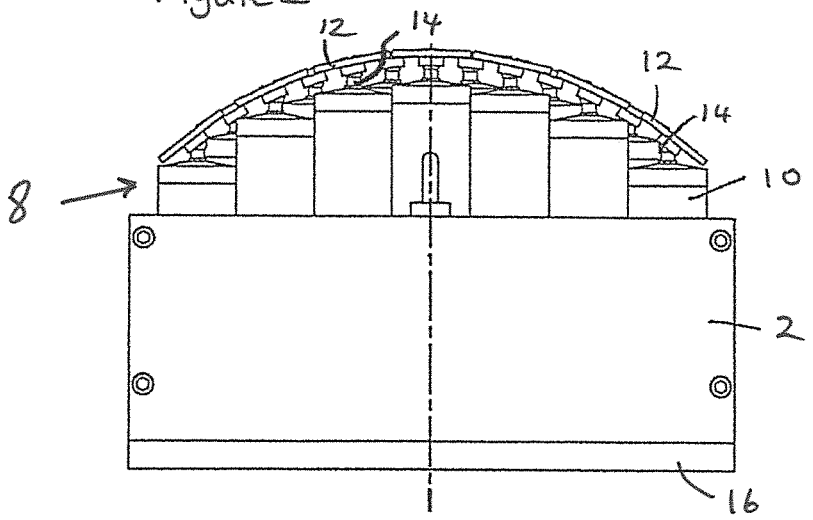
FIG. 3 is an end view of the pin array of FIG. 2.

As best shown in FIGS. 2 and 3, the pins 10 of the pin array 8 are arranged in an hexagonal close packed pattern. Each pin 10 has a circular end cap 12 mounted on an upper end thereof via a ball and socket articulated joint 14, wherein the end cap 12 can tilt with respect to the pin 10 upon which it is mounted.

The pin array 8 is mounted on a base frame 16 between a pair of workpiece gripping devices, each comprising a workpiece support roller 18,20 having an outer surface defining an arcuate workpiece support surface, against which a respective end of the workpiece is clamped by means of an eccentrically mounted clamping roller 22,24 mounted parallel to the respective support roller 18,20. The support rollers 18,20 are mounted between opposing side plates 30,32 of the base frame 16 of the apparatus, as best seen from FIG. 1.

Each clamping roller 22,24 is mounted eccentrically such that the clamping roller 22,24 can be rotated between a first position, wherein the outer surface of the clamping roller 22,24 is spaced from the outer surface of the support roller 18,20, and a second position, wherein the outer surface of the clamping roller 22,24 engages the outer surface of the support roller 18,20.

Figure 5:
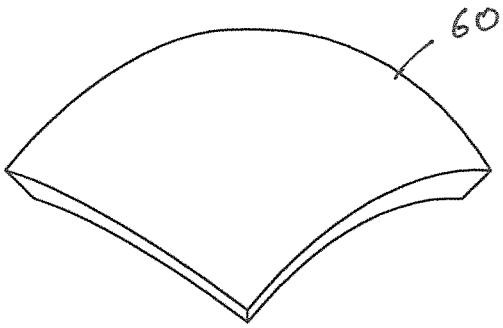
FIG. 5 is a perspective view of a smooth flexible interpolator sheet for producing a smooth panel when applied to the metal forming apparatus of FIG. 1.
Figure 8:
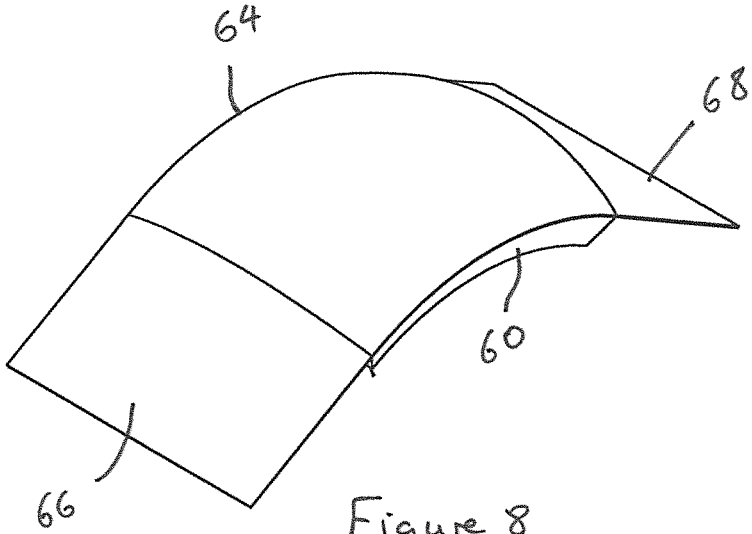
FIG. 8 is a perspective view of the smooth interpolator sheet of FIG. 5 being used to form a smooth panel.
Figure 9:
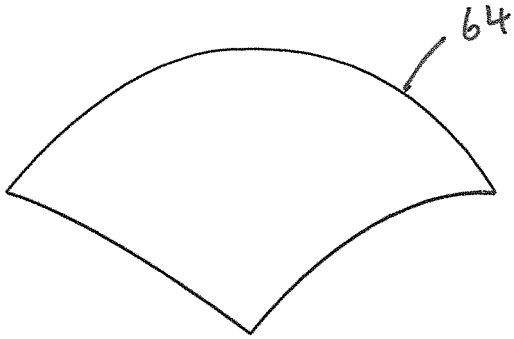
FIG. 9 is a perspective view of the resulting smooth panel.

An operating lever 34 extends substantially radially from each clamping roller 22,24 for moving the respective clamping roller between its first and second positions. As shown in FIG. 5, each operating lever 34 is shaped to abut the outer surface of the adjacent support roller 18,20 when the respective clamping roller 22,24 is in its second position. The direction of rotation of each clamping roller 22,24 between its respective first and second positions is arranged such that a biasing force acting against the clamping roller 18,20 by means of a workpiece clamped between the clamping roller and the adjacent support roller during a stretch forming operation urges the clamping roller towards its second position, increasing the clamping force applied to the workpiece by the clamping roller. The operating levers 34 may be manipulated manually or may be connected to suitable actuators, such as double acting hydraulic rams or suitable electric motors.

A pair of linear actuators 36,38, preferably rams, typically hydraulic or pneumatic double acting rams, are mounted on either side of the pin array 8, to rotate the support rollers 18,20, the actuators 36,38 being arranged such that extension of the actuators 36,38 causes the support rollers 18,20 to rotate in opposite directions, stretching a workpiece over the forming surface 4, as will be described in more detail below.

The support rollers 18,20 are constrained to rotate by equal amounts as the actuators 36,38 are extended and retracted by a suitable linkage means or mechanism. It is envisaged that the support rollers 18,20 may be inter-linked by an elongate linkage or gearing, to ensure that the support rollers rotate by equal amounts and in opposite direction to one another. The counter rotating support rollers 18,20 are adapted to wind a workpiece around the arcuate forming surface 4, and hence stretch the material of the workpiece.

The pin array 8 may be mounted upon the base frame 16 via suitable actuators (not shown) so that the pin array 8 may be raised with respect to the base during a stretch forming operation.

Two different interchangeable flexible interpolator sheets are provided.

Figure 4:
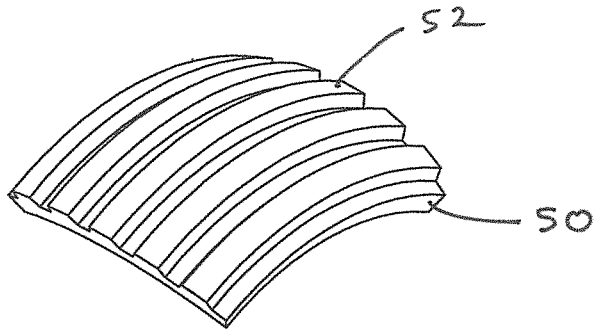
FIG. 4 is a perspective view of a corrugated flexible interpolator sheet for producing a corrugated panel when applied to the metal forming apparatus of FIG. 1.

In order to create a panel having a corrugated or surface featured panel a profiled interpolator sheet 50, illustrated in FIG. 4, has a profiled upper surface defining a series of parallel ribs 52 adapted to create corrugations in the workpiece as it is stretched over the interpolator sheet 50. The interpolator sheet 50 is formed from a resilient flexible material, such as rubber. While the profiled interpolator sheet 50 shown in FIG. 4 is provided with parallel ribs 52, it is envisaged that other surface formations may be formed on the upper surface of the interpolator sheet to product the desired surface features in the panel to be formed thereon.

It is preferred that the profiled interpolator sheet 50 is mounted on the array of pins 8 so that the major dimensions of the ribs 52 or other surface formations on the interpolator sheet are substantially aligned with the direction of stretch generated by the reconfigurable stretch forming apparatus (i.e. the major dimensions of the ribs or surface formations extend between the support rollers 18,20).

In order to create a panel having a smooth outer surface, a smooth interpolator sheet 60 is provided having a smooth upper surface, as shown in FIG. 5. The profiled interpolator sheet 50 can be readily exchanged with the smooth interpolator 60 sheet to produce a smooth panel when desired.

In use, a workpiece, typically a sheet of metal, such as aluminium or steel, is mounted on the apparatus, with opposite ends of the sheet passing between the support rollers 18,20 and clamping rollers 22,24 of the workpiece gripping devices, with the workpiece lying over the forming surface.

Before, or after locating the workpiece onto the apparatus, each pin 10 of the pin array 8 may be adjusted in height such that the forming surface has the desired three dimensional shape. The position of the pins 10 may be manually adjusted, for example via threaded adjusters or may be adjusted by drive devices such as stepper motors or hydraulic actuators. The required position of the pins 10 may be determined by computer software.

Either the profiled interpolator sheet 50 of FIG. 4 or the smooth interpolator sheet 60 of FIG. 5 is mounted on the pin array 8 depending on whether it is desired to produce a panel having a corrugated or surface featured finish or a smooth finish.

The operating levers 34 are manipulated to move the clamping rollers 22,24 towards their second positions, clamping the workpiece between the clamping rollers 22,24 and the respective support rollers 18,20.

The actuators 36,38 are then extended to cause the support rollers 18,20 to rotate in opposite directions, stretching the workpiece over the forming surface 4 defined by the respective interpolator sheet 50,60 to stretch the material into the desired shape. At the same time the pin array 8 may be raised with respect to the base frame 16. It is also envisaged that individual pins 10 may be raised or lowered during a stretch forming operation.

Figure 6:
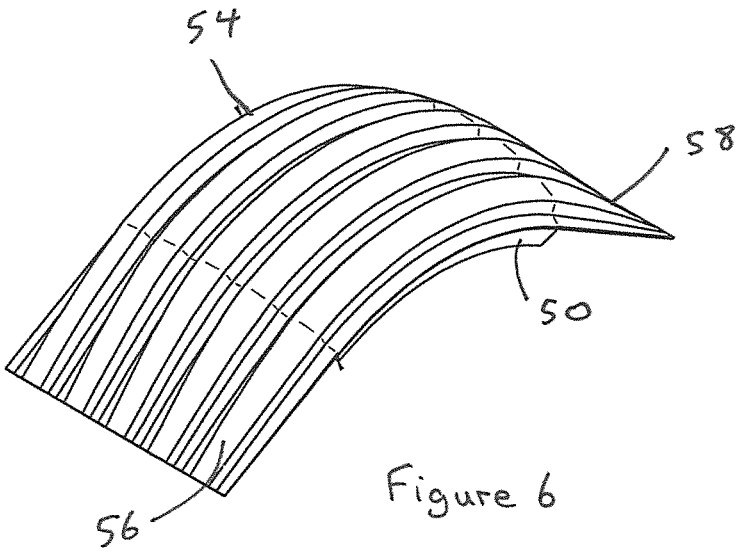
FIG. 6 is a perspective view of the corrugated interpolator sheet of FIG. 4 being used to form a corrugated panel.
Figure 7:
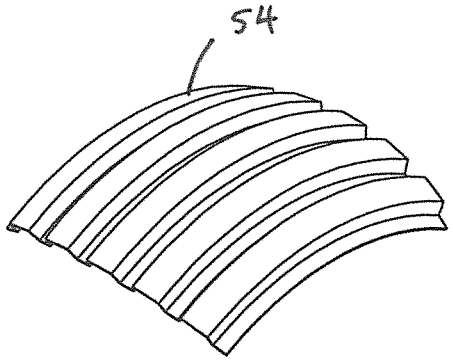
FIG. 7 is a perspective view of the resulting corrugated panel.

When the profiled interpolator sheet 50 is used, the resulting stretch formed panel 54, as shown in FIGS. 6 and 7, is formed with a profiled surface corresponding to the profiled upper surface of the profiled interpolator sheet 50. The end regions 56,58 of the panel extending beyond the interpolator sheet 50 may be trimmed away to form the finished panel.

Note that corrugated profile shown in the drawings is only one of many possible forms, the profile of the interpolator sheet 50 being adapted to produce the desired feature profile in the formed panel.

As discussed above, when it is desired to produce a smooth panel the profiled interpolator sheet 50 is replaced by the smooth interpolator sheet 60 and the stretch process is repeated, as shown in FIGS. 6 and 7, to produce a smooth panel 64. Again, the end regions 66,58 of the resulting panel are trimmed to form the finished panel.

Figure 11:
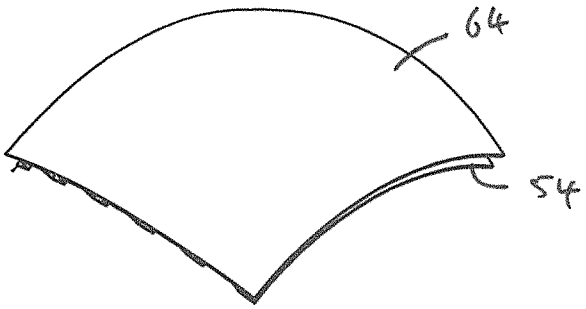
FIG. 11 is a perspective view of the assembled two part panel from above.
Figure 12:
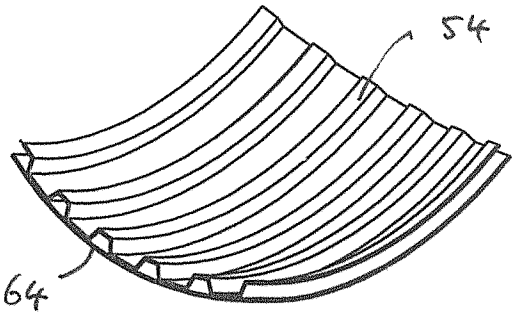
FIG. 12 is a perspective view of the assembled two part panel from below.
Figure 10:
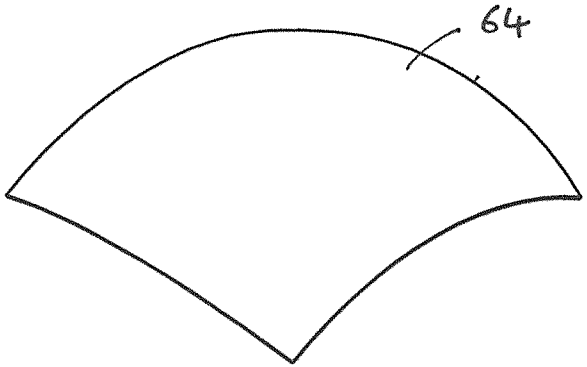
FIG. 10 is a perspective view illustrating the assembly of a two part reinforced panel comprising the corrugated panel of FIG. 7 and the smooth panel of FIG. 9.
Figure 10:
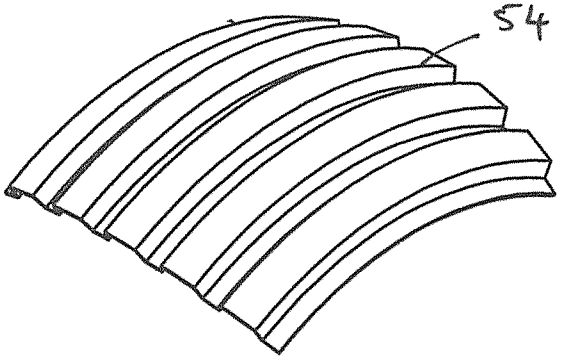

Either panel (profiled 54 or smooth 64) can be used individually, with the feature profile having a comparatively increased second moment of area, thus providing a stiffer panel. It is possible to bring both panels together to form an integrally stiffened structure with the choice of inner or outer skins, as shown in FIGS. 10 to 12. Adhesive, mechanical or fusion methods can be used to join the panels together.

The mounting of the support rollers 18,20 and the actuators 36,38 between the side plates 30,32 of the base frame 16 enables all loads to be reacted through the base frame 16 and actuators 36,38, eliminating the need for expensive and time consuming installation of the apparatus.

As well as permitting the shape of the panel to be varied by adjusting the shape of the forming surface by adjusting the height of individual pins, the profile of the stretch formed panel can be easily changed by simply changing the interpolator sheet to one having an upper surface profiled to produce the desired profile in the finished panel. The increased flexibility from this design increases the number of possible customers who can adopt the new system.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. A method of stretch forming a double curvature panel having corrugations formed therein, comprising:

providing a reconfigurable forming surface defined by a flexible interpolator sheet mounted on an array of height adjustable pins, the interpolator sheet having a profiled upper surface adapted to form corrugations in a workpiece;

adjusting the height of each pin to suit the shape of the panel to be produced;

placing the workpiece onto the forming surface; and stretching the workpiece to draw the workpiece against the forming surface such that the profiled upper surface of the interpolator sheet forms the desired corrugations in the workpiece;

wherein the interpolator sheet is mounted on the array of pins such that a major profile of the corrugations defining the profiled upper surface of the interpolator sheet are substantially aligned with the direction in which the workpiece is stretched over the forming surface.

2. A method as claimed in claim 1, further comprising gripping the workpiece in workpiece gripping devices provided on opposite sides of the array of pins, and displacing the gripping devices in opposing directions and/or raising the pins to stretch the workpiece over the forming surface.

3. A method as claimed in claim 2, further comprising displacing the array of pins upwardly as the gripping devices are displaced in opposite directions.

4. A method as claimed in claim 2, further comprising removing the workpiece from the forming surface and trimming the workpiece to remove portions of the workpiece that had been held in the gripping devices.

5. A method as claimed in claim 2, further comprising:

replacing the interpolator sheet with a second interpolator sheet having a substantially smooth outer surface;

maintaining the height of each pin, placing a second workpiece onto the forming surface defined by the second interpolator sheet;

gripping the second workpiece in the workpiece gripping devices;

displacing the gripping devices in opposing directions to stretch the second workpiece over the forming surface;

removing the second workpiece from the forming surface;

placing the second workpiece in registration with the workpiece having corrugations formed therein; and joining the workpieces to form an integrally stiffened panel.

6. A method as claimed in claim 5, wherein the workpieces are joined by one or more of an adhesive applied to abutting surfaces of the workpieces, mechanical fastening devices, or a welding process.

7. A reconfigurable stretch forming apparatus, comprising:

an array of pins adapted to be individually adjustable in height;

a flexible interpolator sheet mounted on top of the array of pins to define a reconfigurable forming surface;

a pair of workpiece gripping devices being provided on opposite sides of the array of pins, each gripping device having a support surface for supporting a workpiece and a clamping member for clamping a work piece against the support surface;

a drive device operable to displace the gripping devices in opposing directions and/or operable to raise the array of pins to stretch the work piece over the forming surface; and the interpolator sheet having a profiled upper surface adapted to form corrugations in the workpiece as it is stretched while being drawn against the forming surface defined by the interpolator sheet;

wherein the profiled upper surface of the interpolator sheet defines a plurality of substantially parallel ribs adapted to form the corrugations in the workpiece, and wherein the substantially parallel ribs are aligned with the direction in which the work piece is stretched.

8. An apparatus as claimed in claim 7, wherein the interpolator sheet incorporates varying thickness regions to define the profiled upper surface thereof.

9. An apparatus as claimed in claim 7, wherein the ribs are aligned to extend between the gripping devices over the full length of the forming surface.

10. An apparatus as claimed in claim 7, further comprising a second interpolator sheet having a substantially smooth outer surface for producing a panel having a substantially smooth surface, wherein the interpolator sheet is removable and replaceable with the second interpolator sheet.

11. An apparatus as claimed in claim 10, wherein the interpolator sheet and the second interpolator sheet are adapted to be used subsequently to one another to produce separate formed sheets upon the same configuration of pins to produce a smooth panel and a corrugated panel which can be subsequently joined to produce an integrally reinforced multi-layer panel.

12. An apparatus as claimed in claim 7, wherein each of the gripping devices comprises a roller, a respective outer surface of each of the rollers defining the support surface of the respective gripping device.

13. An apparatus as claimed in claim 12, wherein the clamping member of each gripping device comprises:

an eccentrically mounted cam or roller mounted adjacent the arcuate support surface of the respective gripping device; and an outer surface of the clamping member defining a clamping surface acting against the arcuate support surface to clamp the workpiece thereagainst, wherein the clamping member is rotatable between a first position in which the clamping surface of the clamping member is spaced from the arcuate support surface, and a second position in which the clamping surface of the clamping member engages the arcuate support surface.

14. An apparatus as claimed in claim 13, wherein the clamping member of each gripping device is eccentrically rotatable about an axis extending parallel to a rotation axis of the respective gripping device.

15. An apparatus as claimed in claim 14, wherein the direction of rotation of the clamping member of each gripping device between its first and second positions is such that the respective clamping member is biased towards its second position under the action of the workpiece during a stretch forming operation.

16. An apparatus as claimed in claim 7, wherein the array of pins and the flexible interpolator sheet supported thereon define an arcuate forming surface extending between the gripping devices.

17. An apparatus as claimed in claim 7, wherein an end cap is mounted on an upper end of each pin, wherein each end cap is articulated with respect to the pin upon which the end cap is mounted to permit tilting of the end cap with respect to the pin.

18. An apparatus as claimed claim 7, wherein the gripping devices are linked to ensure that the gripping devices are displaced by equal amounts when the drive device is operated to ensure even stretching of the workpiece along the forming surface.

19. A reconfigurable stretch forming apparatus, comprising:

an array of pins adapted to be individually adjustable in height;

a flexible interpolator sheet mounted on top of the array of pins to define a reconfigurable forming surface;

a pair of workpiece gripping devices being provided on opposite sides of the array of pins, each gripping device having a support surface for supporting a workpiece and a clamping member for clamping a work piece against the support surface;

a drive device operable to displace the gripping devices in opposing directions and/or operable to raise the array of pins to stretch the work piece over the forming surface; and the interpolator sheet having a profiled upper surface adapted to form corrugations in the workpiece as it is stretched while being drawn against the forming surface defined by the interpolator sheet;

wherein the interpolator sheet is mounted on the array of pins such that a major profile of the corrugations defining the profiled upper surface of the interpolator sheet are substantially aligned with the direction in which the workpiece is stretched over the forming surface.

20. An apparatus as claimed in claim 19, wherein the profiled upper surface of the interpolator sheet defines a plurality of substantially parallel ribs adapted to form the corrugations in the workpiece.

* * * * *